US010431156B2

(12) United States Patent
Zhang et al.

(10) Patent No.: US 10,431,156 B2
(45) Date of Patent: Oct. 1, 2019

(54) PIXEL CIRCUIT AND DRIVING METHOD THEREOF AND DISPLAY DEVICE

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Kai Zhang, Beijing (CN); Yi Zhang, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 15/763,615

(22) PCT Filed: Sep. 14, 2017

(86) PCT No.: PCT/CN2017/101702

§ 371 (c)(1),
(2) Date: Mar. 27, 2018

(87) PCT Pub. No.: WO2018/149122

PCT Pub. Date: Aug. 23, 2018

(65) Prior Publication Data

US 2019/0051238 A1 Feb. 14, 2019

(30) Foreign Application Priority Data

Feb. 17, 2017 (CN) ..... 2017 1 0086986

(51) Int. Cl.
*G09G 3/3233* (2016.01)
*G09G 3/3258* (2016.01)
(Continued)

(52) U.S. Cl.
CPC ..... *G09G 3/3233* (2013.01); *G09G 3/3258* (2013.01); *G09G 3/3266* (2013.01);
(Continued)

(58) Field of Classification Search
CPC .. G09G 3/3233; G09G 3/3275; G09G 3/3266; G09G 3/3258; G09G 2300/0852;
(Continued)

(56) References Cited

U.S. PATENT DOCUMENTS

2011/0227956 A1 9/2011 Park et al.
2013/0043802 A1 2/2013 Han et al.
2015/0356924 A1* 12/2015 Chen ..... G09G 3/3233 345/690
2015/0379956 A1* 12/2015 Nonaka ..... G09G 3/3233 315/172
(Continued)

FOREIGN PATENT DOCUMENTS

CN 102194405 A 9/2011
CN 102842283 A 12/2012
(Continued)

OTHER PUBLICATIONS

International Search Report and Written Opinion dated Dec. 20, 2017; PCT/CN2017/101702.

*Primary Examiner* — Ryan A Lubit
(74) *Attorney, Agent, or Firm* — Ladas & Parry LLP

(57) ABSTRACT

A pixel circuit and a driving method thereof, and a display device. The pixel circuit includes an input sub-circuit, a driving sub-circuit, a light emitting control sub-circuit, a light emitting sub-circuit and a voltage stabilizing sub-circuit; the voltage stabilizing sub-circuit is connected respectively to a second node and a voltage stabilizing signal terminal in the pixel circuit, and configured to stabilize a voltage level at the second node under control of a voltage stabilizing signal from the voltage stabilizing signal terminal, and the voltage level of the voltage stabilizing signal is unchanged during driving process of the pixel circuit.

19 Claims, 6 Drawing Sheets

(51) Int. Cl.
*G09G 3/3266* (2016.01)
*G09G 3/3275* (2016.01)

(52) U.S. Cl.
CPC ... *G09G 3/3275* (2013.01); *G09G 2300/0814* (2013.01); *G09G 2300/0819* (2013.01); *G09G 2300/0852* (2013.01); *G09G 2300/0861* (2013.01); *G09G 2310/0262* (2013.01); *G09G 2310/08* (2013.01); *G09G 2320/0233* (2013.01)

(58) Field of Classification Search
CPC ... G09G 2300/0814; G09G 2300/0861; G09G 2300/0819; G09G 2310/08; G09G 2310/0262; G09G 2320/0233
See application file for complete search history.

(56) References Cited

U.S. PATENT DOCUMENTS

| | | | | |
|---|---|---|---|---|
| 2016/0117990 | A1* | 4/2016 | Qian | G09G 3/3258 345/690 |
| 2017/0358261 | A1* | 12/2017 | Zhou | G09G 3/3258 |
| 2018/0218673 | A1* | 8/2018 | Li | G09G 3/3233 |

FOREIGN PATENT DOCUMENTS

| | | | |
|---|---|---|---|
| CN | 102956192 | A | 3/2013 |
| CN | 205722741 | U | 11/2016 |
| CN | 106782324 | A | 5/2017 |
| KR | 1020040009285 | A | 1/2004 |

* cited by examiner

PIXEL CIRCUIT AND DRIVING METHOD THEREOF AND DISPLAY DEVICE

TECHNICAL FIELD

The present disclosure relates to the field of display technology, and more particularly to a pixel circuit and a driving method thereof, and a display device.

BACKGROUND

Pixel circuit is a circuit structure that controls a current flowing through an organic light emitting diode (OLED) by a driving transistor.

In the related art, an OLED pixel circuit generally comprises an OLED, a plurality of driving transistors and a capacitor. The plurality of driving transistors is capable of converting a data signal at a data signal terminal into a driving current for driving the OLED under the control of a scan signal terminal. Part of the driving transistors in the OLED pixel circuit are further connected to a light emitting control terminal, and display luminance of an OLED display device can be adjusted by adjusting a pulse width of a light emitting control signal outputted from the light emitting control terminal.

However, in the process of adjusting the pulse width of the light emitting control signal, the voltage at some nodes in the pixel circuit may be unstable, which affects the uniformity of display luminance of the OLED display device.

SUMMARY

In order to solve the problem that the voltage at some nodes in the pixel circuit may be unstable, which affects the uniformity of display luminance of the OLED display device as exiting in the related art, the present disclosure provides a pixel circuit and a driving method thereof, and a display device.

In a first aspect, there is provided a pixel circuit, comprising: an input sub-circuit, a driving sub-circuit, a light emitting control sub-circuit, a light emitting sub-circuit and a voltage stabilizing sub-circuit; the input sub-circuit is connected respectively to a scan signal terminal, a data signal terminal, a first node, a second node and a third node, and configured to output a data signal from the data signal terminal to the second node and connect the third node with the first node under control of a scan signal from the scan signal terminal; the driving sub-circuit is connected respectively to a first power source signal terminal, the first node, the second node and the third node, and configured to adjust a voltage level at the first node according to a voltage level at the second node and a first power source signal outputted from the first power source signal terminal when the input sub-circuit connects the third node with the first node, and output a driving current to the third node according to a first power source signal outputted from the first power source signal terminal under control of the first node when the input sub-circuit does not connect the third node with the first node; the light emitting control sub-circuit is connected respectively to a light emitting control signal terminal, a reference signal terminal, the second node, the third node and one terminal of the light emitting sub-circuit, and configured to control a voltage level at the second node according to a reference signal from the reference signal terminal under control of a light emitting control signal from the light emitting control signal terminal, and output the driving current to the light emitting sub-circuit under control of a light emitting control signal from the light emitting control signal terminal; the other terminal of the light emitting sub-circuit is connected to a second power source signal terminal, the light emitting sub-circuit is configured to emit light under driving of the driving current; the voltage stabilizing sub-circuit is connected respectively to the second node and a voltage stabilizing signal terminal, and configured to stabilize a voltage level at the second node under control of a voltage stabilizing signal from the voltage stabilizing signal terminal, and the voltage level of the voltage stabilizing signal keep unchanged during driving process of the pixel circuit.

In an embodiment, the pixel circuit further comprises a reset sub-circuit connected respectively to a reset signal terminal, an initializing signal terminal and the first node, configured to output an initializing signal from the initializing signal terminal to the first node under control of a reset signal from the reset signal terminal.

In an embodiment, the voltage stabilizing signal terminal is any one of the first power source signal terminal, the second power source signal terminal, the reference signal terminal and the initializing signal terminal.

In an embodiment, the voltage stabilizing sub-circuit comprises: a first capacitor; one terminal of the first capacitor is connected to the second node, and the other terminal of the first capacitor is connected to the voltage stabilizing signal terminal.

In an embodiment, the input sub-circuit comprises: a second transistor and a fourth transistor; a gate of the second transistor is connected to the scan signal terminal, a first electrode of the second transistor is connected to the third node, and a second electrode of the second transistor is connected to the first node; a gate of the fourth transistor is connected to the scan signal terminal, a first electrode of the fourth transistor is connected to the data signal terminal, and a second electrode of the fourth transistor is connected to the second node.

In an embodiment, the driving sub-circuit comprises: a third transistor and a second capacitor; a gate of the third transistor is connected to the first node, a first electrode of the third transistor is connected to the first power source signal terminal, and a second electrode of the third transistor is connected to the third node; one terminal of the second capacitor is connected to the first node, and the other terminal of the second capacitor is connected to the second node.

In an embodiment, the light emitting control sub-circuit comprises: a fifth transistor and a sixth transistor; a gate of the fifth transistor is connected to the light emitting control signal terminal, a first electrode of the fifth transistor is connected to the reference signal terminal, and a second electrode of the fifth transistor is connected to the second node; a gate of the sixth transistor is connected to the light emitting control signal terminal, a first electrode of the sixth transistor is connected to the third node, and a second electrode of the sixth transistor is connected to one terminal of the light emitting sub-circuit.

In an embodiment, the light emitting sub-circuit comprises: an organic light emitting diode OLED; one terminal of the OLED is connected to the light emitting control sub-circuit, and the other terminal of the OLED is connected to the second power source signal terminal.

In an embodiment, the transistors are all P-type transistors.

In an embodiment, the reset sub-circuit comprises: a first transistor; a gate of the first transistor is connected to the reset signal terminal, a first electrode of the first transistor is connected to the initializing signal terminal, and a second electrode of the first transistor is connected to the first node.

In a second aspect, there is provided a driving method of a pixel circuit, used for driving the pixel circuit according to the first aspect, the driving method comprising: a data voltage writing stage, in which the scan signal outputted from the scan signal terminal is at a first voltage level, the input sub-circuit outputs the data signal from the data signal terminal to the second node and connects the first node N1 and the third node N3, and the driving sub-circuit adjusts a voltage level at the first node according to the first power source signal outputted from the first power source signal terminal and the data signal; a light emitting stage, in which the light emitting control signal outputted from the light emitting control signal terminal is at a first voltage level, and the light emitting control sub-circuit adjusts a voltage level at the second node according to a voltage level of the reference signal outputted from the reference signal terminal, and the driving sub-circuit adjusts a voltage level at the first node according to a voltage level at the second node, and outputs a driving current to the third node under control of the first node, the light emitting control sub-circuit outputs the driving current to the light emitting sub-circuit, and the light emitting sub-circuit emits light; a first maintaining stage, in which a voltage level of the light emitting control signal outputted from the light emitting control signal terminal jumps from a first voltage level to a second voltage level, and the voltage stabilizing sub-circuit maintains a voltage level at the second node unchanged under control of the voltage stabilizing signal outputted from the voltage stabilizing signal terminal; and a second maintaining stage, in which a voltage level of the light emitting control signal outputted from the light emitting control signal terminal jumps from a second voltage level to a first voltage level, the light emitting control sub-circuit adjusts a voltage level at the second node according to a voltage level of the reference signal outputted from the reference signal terminal; the driving sub-circuit adjusts a voltage level at the first node according to a voltage level at the second node, and outputs a driving current to the third node under control of the first node; the light emitting control sub-circuit outputs the driving current to the light emitting sub-circuit, and the light emitting sub-circuit emits light.

In an embodiment, the first maintaining stage and the second maintaining stage are alternated when a voltage level of the light emitting control signal jumps between a first voltage level and a second voltage level.

In an embodiment, the voltage stabilizing sub-circuit comprises a first capacitor; the input sub-circuit comprises a second transistor and a fourth transistor; and the driving sub-circuit comprises, a third transistor and a second capacitor; the light emitting control sub-circuit comprises a fifth transistor and a sixth transistor; the light emitting sub-circuit comprises an organic electroluminescent diode OLED; in the data writing stage, the scan signal is at a first voltage level, the second transistor and the fourth transistor are turned on, and the data signal terminal outputs the data signal to the second node, the third transistor is turned on, and a voltage level at the first node is adjusted according to a voltage level of the first power source signal; in the light emitting stage, the light emitting control signal is at a first voltage level, the fifth transistor and the sixth transistor are turned on, the reference signal terminal outputs the reference signal to the second node, and the second capacitor adjusts a voltage level at the first node according to a voltage level at the second node, the third transistor is turned on and outputs a driving current to the OLED, and the OLED emits light; in the first maintaining stage, the light emitting control signal is at a second voltage level, and the first capacitor maintains a voltage level at the second node unchanged under control of the voltage stabilizing signal; in the second maintaining stage, a voltage level of the light emitting control signal is at a first voltage level, the fifth transistor and the sixth transistor are turned on, and the reference signal terminal outputs the reference signal to the second node, the second capacitor adjusts a voltage level at the first node according to a voltage level at the second node, the third transistor is turned on and outputs a driving current to the OLED, and the OLED emits light.

In an embodiment, the pixel circuit further comprises a reset sub-circuit connected respectively to a reset signal terminal, an initializing signal terminal and the first node, and configured to output an initializing signal from the initializing signal terminal to the first node under control of a reset signal from the reset signal terminal, the driving method further comprises: a resetting stage, which is prior to the data voltage writing stage and in which the reset signal outputted from the reset signal terminal is at a first voltage level and the reset sub-circuit outputs an initializing signal from the initializing signal terminal to the first node, and the initializing signal is at a first voltage level.

In an embodiment, the reset sub-circuit comprises: a first transistor; in the resetting stage, the reset signal is at a first voltage level, the first transistor is turned on, and the initializing signal terminal outputs the initializing signal to the first node.

In an embodiment, prior to the resetting stage, the driving method further comprises: a preparing stage; in the preparing stage, the reset signal and the scan signal are both at a second voltage level, the light emitting control signal jumps from a first voltage level to a second voltage level, the first transistor, the second transistor, and the fourth to sixth transistors are all turned off, and the first capacitor maintains a voltage level at the second node unchanged under control of the voltage stabilizing signal.

In an embodiment, the driving method further comprises a first transition stage after the resetting stage and prior to the data voltage writing stage; the driving method further comprises a second transition stage after the data voltage writing stage and prior to the light emitting stage; in the first transition stage, the reset signal jumps from a first voltage level to a second voltage level, and signals outputted from the scan signal terminal and the light emitting control signal terminal both are at a second voltage level, and the first to sixth transistors are all turned off; in the second transition stage, the reset signal maintains a second voltage level, the scan signal jumps from a first voltage level to a second voltage level, the second capacitor causes voltage levels at the first node and the second node to maintain unchanged.

In an embodiment, the transistors are all P-type transistors, and the first voltage level is a low voltage level with respect to the second voltage level.

In a third aspect, there is provided a display device, comprising: the pixel circuit according to the first aspect.

Beneficial effects produced by the technical solutions provided by the present disclosure are: the present disclosure provides a pixel circuit and a driving method thereof, and a display device, the pixel circuit further comprises a voltage stabilizing sub-circuit, one terminal of the voltage stabilizing sub-circuit is connected to a voltage stabilizing signal terminal and the other terminal of the voltage stabilizing sub-circuit is connected to a second node. Since a voltage level of the voltage stabilizing signal outputted from the voltage stabilizing signal terminal is a fixed voltage level, the voltage stabilizing sub-circuit can maintain a voltage level at the second node stable during driving process of the pixel circuit, and avoid the influence caused by a voltage level change of the light emitting control signal on a voltage level of the second node, thereby prevent an uneven luminance phenomenon from happening to the display device.

BRIEF DESCRIPTION OF THE DRAWINGS

In order to describe the technical solutions in the embodiments of the present disclosure more clearly, the accompanying drawings in the embodiments are briefly introduced below. Apparently, the accompanying drawings in the following description relate to only some embodiments of the present disclosure, and are not intended to limit the present disclosure.

DETAILED DESCRIPTION OF THE EMBODIMENTS

Figure 1:
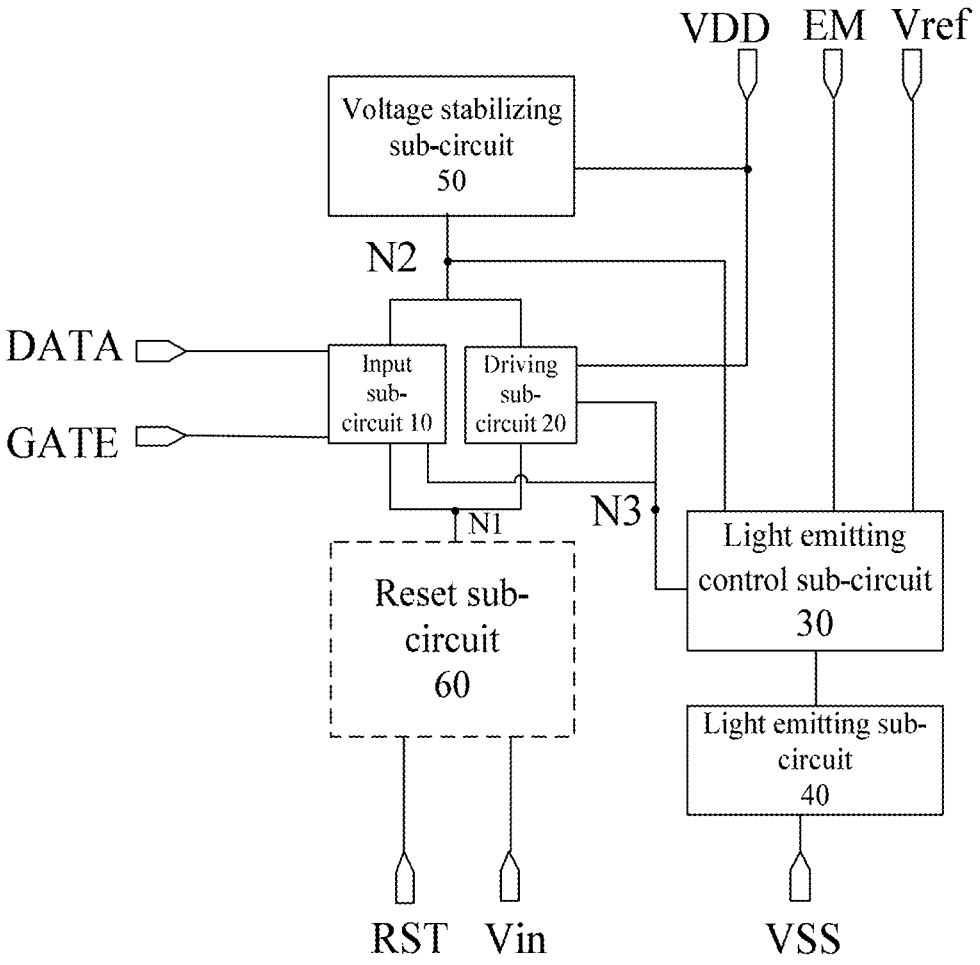
FIG. 1 is a schematic block diagram of a pixel circuit according to an embodiment of the present disclosure.

For the objectives, technical solutions, and advantages of the embodiments of the present disclosure to be clearer, hereinafter, the technical solutions in the embodiments of the present disclosure will be described clearly and comprehensively in combination with the accompanying drawings. Obviously, these described embodiments are merely parts of the embodiments of the present disclosure, rather than all of the embodiments thereof. Other embodiments obtained by a person of ordinary skill in the art based on the embodiments of the present disclosure without paying creative effort all fall into the protection scope of the present disclosure.

Transistors adopted in all of the embodiments of the present disclosure may be a thin film transistor, or a field effect transistor, or other devices having the same properties each, based on a function achieved in the circuit, transistors adopted in the embodiments of the present disclosure mainly are switching transistors. Since the source and the drain of the switching transistors adopted here are symmetrical, the source and the drain of these transistors may be interchanged. In the embodiments of the present disclosure, the source thereof is referred to as a first terminal, and the drain thereof is referred to as a second terminal. According to configurations in the drawings, it is prescribed that an intermediate terminal of the transistors is a gate, a terminal for inputting a signal is a source, and a terminal for outputting a signal is a drain. In addition, transistors adopted in the embodiments of the present disclosure may comprise any of a P-type switching transistor and an N-type switching transistor, wherein the P-type switching transistor is turned on when a gate thereof is at a low voltage level and turned off when a gate thereof is at a high voltage level, and the N-type switching transistor is turned on when a gate thereof is at a high voltage level and turned off when a gate thereof is at a low voltage level. In addition, the multiple signals in various embodiments of the present disclosure all have a first voltage level and a second voltage level correspondingly. The first voltage level and the second voltage level only represent that a voltage level of the signal has two states, and does not mean that the first voltage level or the second voltage level throughout the text has a specific numerical value.

FIG. 1 is a schematic diagram of the structure of a pixel circuit according to an embodiment of the present disclosure. As shown in FIG. 1, the pixel circuit may comprise an input sub-circuit 10, a driving sub-circuit 20, a light emitting control sub-circuit 30, a light emitting sub-circuit 40 and a voltage stabilizing sub-circuit 50.

The input sub-circuit 10 is connected respectively to a scan signal terminal GATE, a data signal terminal DATA, a first node N1, a second node N2 and a third node N3, and configured to output a data signal from the data signal terminal DATA to the second node N2 and connect the third node N3 with the first node N1 under control of a scan signal from the scan signal terminal GATE.

The driving sub-circuit 20 is connected respectively to a first power source signal terminal VDD, the first node N1, the second node N2 and the third node N3, and configured to adjust a voltage level at the first node N1 according to a voltage level at the second node N2 and a first power source signal outputted from the first power source signal terminal VDD when the input sub-circuit 10 connects the third node N3 with the first node N1, and output a driving current to the third node N3 according to a first power source signal outputted from the first power source signal terminal VDD under control of the first node N1 when the input sub-circuit 10 does not connect the third node N3 with the first node N1.

The light emitting control sub-circuit 30 is connected respectively to a light emitting control signal terminal EM, a reference signal terminal Vref, the second node N2, the third node N3 and one terminal of the light emitting sub-circuit 40, and configured to control a voltage level at the second node N2 according to a reference signal from the reference signal terminal Vref under control of a light emitting control signal from the light emitting control signal terminal EM, and output the driving current to the light emitting sub-circuit 40 under control of a light emitting control signal from the light emitting control signal terminal EM.

The other terminal of the light emitting sub-circuit 40 is connected to a second power source signal terminal VSS, and the light emitting sub-circuit 40 is configured to emit light under driving of the driving current.

The voltage stabilizing sub-circuit 50 is connected respectively to the second node N2 and a voltage stabilizing signal terminal, and configured to stabilize a voltage level at the second node N2 under control of a voltage stabilizing signal from the voltage stabilizing signal terminal, and a voltage level of the voltage stabilizing signal maintain unchanged during driving process of the pixel circuit. For example, in FIG. 1, the voltage stabilizing signal terminal is the first power source signal terminal VDD, the first power source signal outputted from the first power source signal terminal VDD is always at a second voltage level during driving process of the pixel circuit.

The pixel circuit shown in FIG. 1 may further comprise a reset sub-circuit 60. The reset sub-circuit 60 is connected respectively to a reset signal terminal RST, an initializing signal terminal Vin and the first node N1, configured to output an initializing signal from the initializing signal terminal to the first node N1 under control of a reset signal from the reset signal terminal RST.

To sum up, an embodiment of the present disclosure provides a pixel circuit, the pixel circuit comprises a voltage stabilizing sub-circuit, one terminal of the voltage stabilizing sub-circuit is connected to a voltage stabilizing signal terminal and the other terminal of the voltage stabilizing sub-circuit is connected to the second node. Since a voltage level of the voltage stabilizing signal outputted from the voltage stabilizing signal terminal is a fixed voltage level, the voltage stabilizing sub-circuit can make a voltage level at the second node maintain stable during driving process of the pixel circuit, and avoid the influence caused by a voltage level change of the light emitting control signal on a voltage level of the second node, thereby preventing an uneven luminance phenomenon from happening to the display device.

In an embodiment of the present disclosure, since voltage levels of the signals outputted from the first power source signal terminal VDD, the second power signal terminal VSS, the reference signal terminal Vref and the initializing signal terminal Vin in the pixel circuit always maintain unchanged during the driving process, the voltage stabilizing signal terminal connected to the voltage stabilizing sub-circuit may be any one of the first power source signal terminal VDD, the second power signal terminal VSS, the reference signal terminal Vref and the initializing signal terminal Vin.

Figure 2:
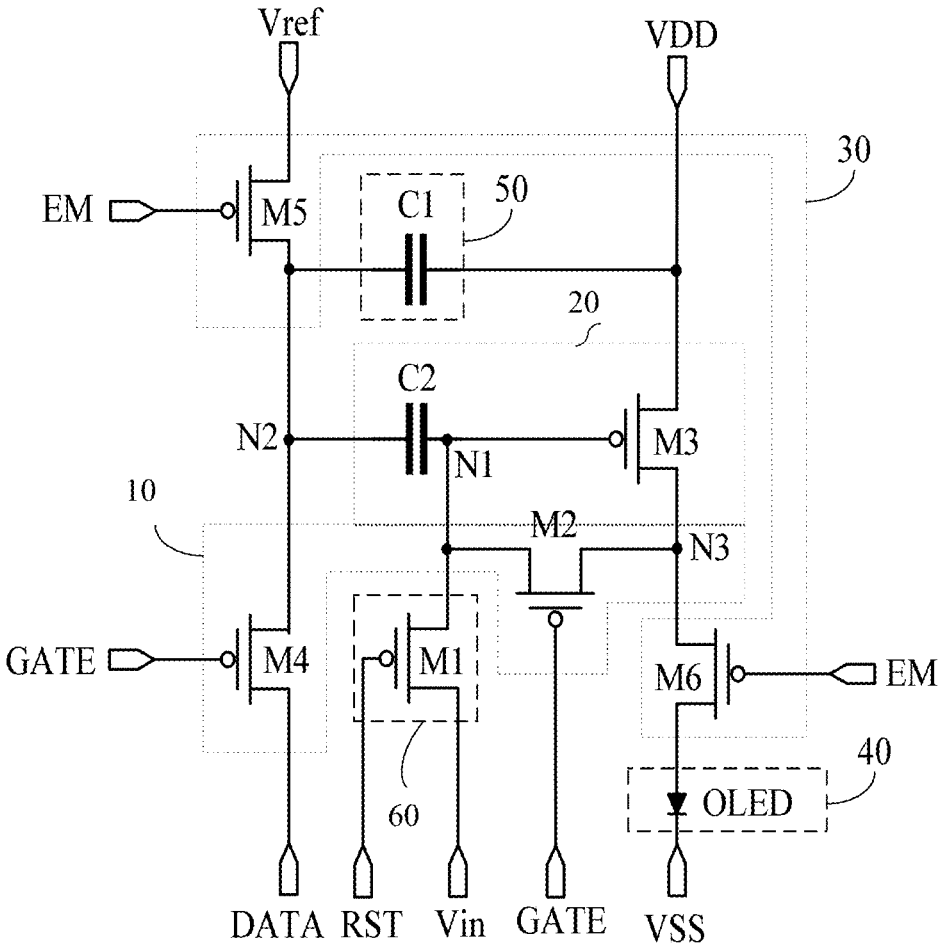
FIG. 2 is a schematic circuit diagram of the pixel circuit shown in FIG. 1 according to an embodiment of the present disclosure.
Figure 3:
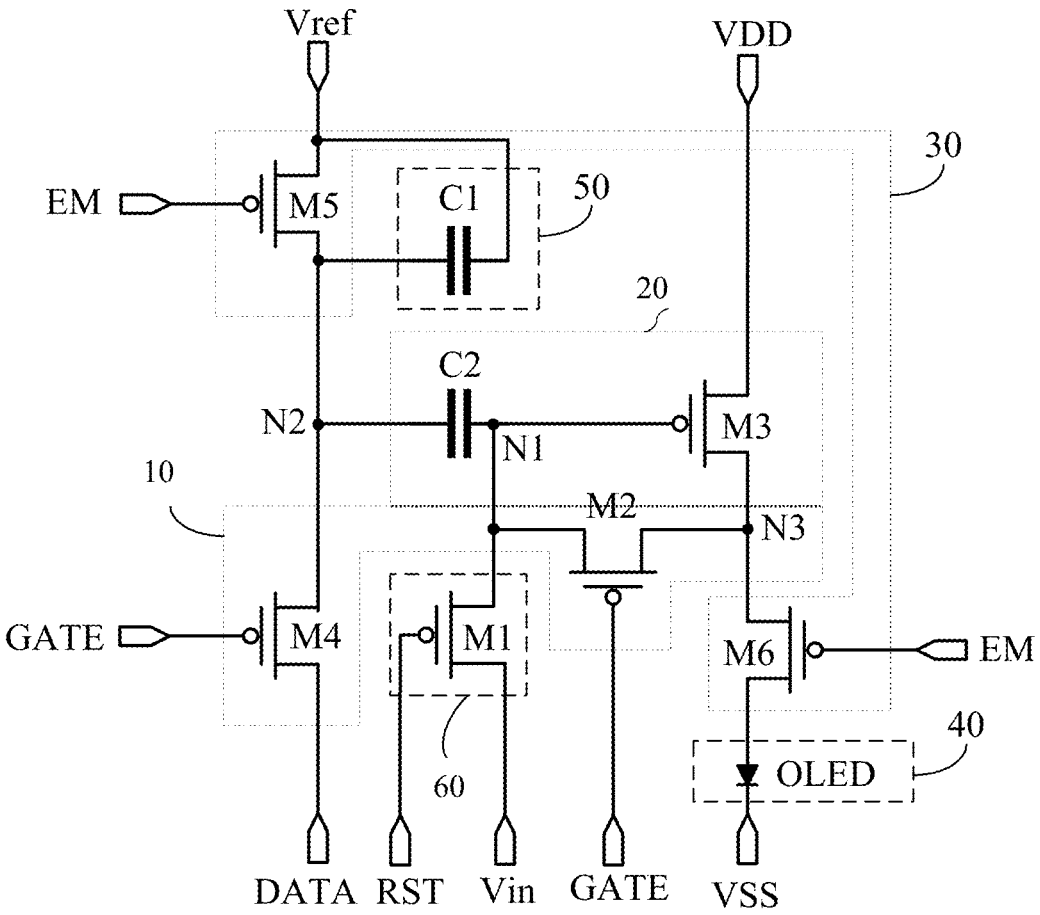
FIG. 3 is another schematic circuit diagram of the pixel circuit shown in FIG. 1 according to an embodiment of the present disclosure.
Figure 4:
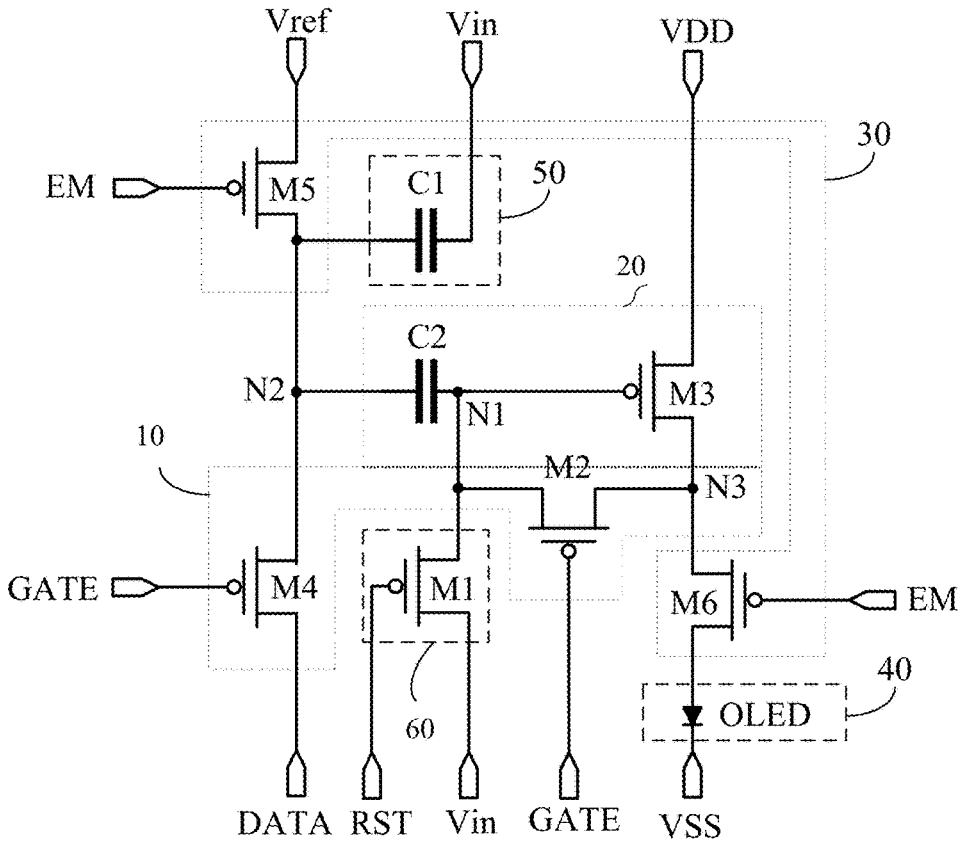
FIG. 4 is another schematic circuit diagram of the pixel circuit shown in FIG. 1 according to an embodiment of the present disclosure.

FIGS. 2 to 4 are schematic circuit diagrams of a pixel circuit according to an embodiment of the present disclosure. Referring to FIG. 2, the voltage stabilizing signal terminal may be the first power source signal terminal VDD, and a voltage level of the first power source signal outputted from the first power source signal terminal VDD is always a second voltage level; alternatively, as shown in FIG. 3, the voltage stabilizing signal terminal may be the reference signal terminal Vref, and a voltage level of the reference signal outputted from the reference signal terminal Vref is always a second voltage level; alternatively, as shown in FIG. 4, the voltage stabilizing signal terminal may be the initializing signal terminal Vin, a voltage level of the initializing signal outputted from the initializing signal terminal Vin is always a first voltage level.

In some embodiments, referring to FIGS. 2 to 4, the input sub-circuit 10 may comprise a second transistor M2 and a fourth transistor M4. Specifically, a gate of the second transistor M2 is connected to the scan signal terminal GATE, a first electrode of the second transistor M2 is connected to the third node N3, and a second electrode of the second transistor M2 is connected to the first node N1; a gate of the fourth transistor M4 is connected to the scan signal terminal GATE, a first electrode of the fourth transistor M4 is connected to the data signal terminal DATA, and a second electrode of the fourth transistor M4 is connected to the second node N2. The input sub-circuit 10 is configured to output a data signal from the data signal terminal DATA to the second node N2 under control of a scan signal from the scan signal terminal GATE, and connect the third node N3 with the first node N1.

The driving sub-circuit 20 may comprises a third transistor M3 and a second capacitor C2. Specifically, a gate of the third transistor M3 is connected to the first node N1, a first electrode of the third transistor M3 is connected to the first power source signal terminal VDD, and a second electrode of the third transistor M3 is connected to the third node N3; one terminal of the second capacitor C2 is connected to the first node N1, and the other terminal of the second capacitor C2 is connected to the second node N2. The driving sub-circuit 20 is configured to adjust a voltage level at the first node N1 according to a voltage level at the second node N2 and a first power source signal outputted from the first power source signal terminal VDD when the input sub-circuit 10 connects the third node N3 with the first node N1, and output a driving current to the third node N3 according to a first power source signal outputted from the first power source signal terminal VDD under control of the first node N1 when the input sub-circuit 10 does not connect the third node N3 with the first node N1.

The light emitting control sub-circuit 30 may comprise a fifth transistor M5 and a sixth transistor M6. Specifically, a gate of the fifth transistor M5 is connected to the light emitting control signal terminal EM, a first electrode of the fifth transistor M5 is connected to the reference signal terminal Vref, and a second electrode of the fifth transistor M5 is connected to the second node N2; a gate of the sixth transistor M6 is connected to the light emitting control signal terminal EM, a first electrode of the sixth transistor M6 is connected to the third node N3, and a second electrode of the sixth transistor M6 is connected to one terminal of the light emitting sub-circuit 40. The light emitting control sub-circuit 30 is configured to control a voltage level at the second node N2 according to a reference signal from the reference signal terminal Vref under control of a light emitting control signal from the light emitting control signal terminal EM, and output the driving current to the light emitting sub-circuit 40 under control of a light emitting control signal from the light emitting control signal terminal EM.

The light emitting sub-circuit 40 may comprise an organic light emitting diode OLED. One terminal of the OLED is connected to the light emitting control sub-circuit 30, and the other terminal of the OLED is connected to the second power source signal terminal VSS. The light emitting sub-circuit 40 is configured to emit light under driving of the driving current.

The voltage stabilizing sub-circuit 50 may comprise a first capacitor C1. One terminal of the first capacitor C1 is connected to the second node N2, and the other terminal of the first capacitor C1 is connected to the voltage stabilizing signal terminal. The voltage stabilizing sub-circuit 50 is configured to stabilize a voltage level at the second node N2 under control of a voltage stabilizing signal from the voltage stabilizing signal terminal.

In an embodiment, the pixel circuit may further comprise a reset sub-circuit 60. The reset sub-circuit 60 may comprise a first transistor M1. Specifically, a gate of the first transistor M1 is connected to the reset signal terminal RST, a first electrode of the first transistor M1 is connected to the initializing signal terminal Vin, and a second electrode of the first transistor M1 is connected to the first node N1. The reset sub-circuit 60 is configured to output an initializing signal from the initializing signal terminal Vin to the first node N1 under control of a reset signal from the reset signal terminal RST.

To sum up, an embodiment of the present disclosure provides a pixel circuit, the pixel circuit comprises a voltage stabilizing sub-circuit, one terminal of the voltage stabilizing sub-circuit being connected to a voltage stabilizing signal terminal and the other terminal of the voltage stabilizing sub-circuit being connected to the second node. Since a voltage level of the voltage stabilizing signal outputted from the voltage stabilizing signal terminal is a fixed voltage level, the voltage stabilizing sub-circuit can maintain a voltage level at the second node stable during driving process of the pixel circuit, and avoid the influence caused by a voltage level change of the light emitting control signal on a voltage level of the second node, thereby prevent an uneven luminance phenomenon from happening to the display device.

Figure 5:
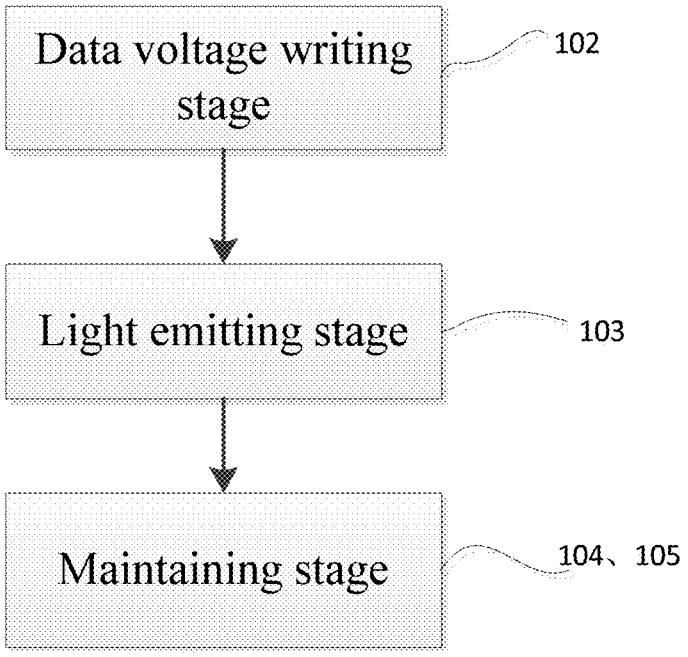
FIG. 5 is a flowchart of a driving method of a pixel circuit according to an embodiment of the present disclosure.

FIG. 5 is a flowchart of a driving method of a pixel circuit according to an embodiment of the present disclosure, the driving method is used for driving the pixel circuit shown in any one of FIGS. 1 to 4. Referring to FIG. 5, the driving method may comprise the following steps.

Step 102, a data voltage writing stage, in which the scan signal outputted from the scan signal terminal GATE is at a first voltage level, the input sub-circuit 10 outputs the data signal from the data signal terminal DATA to the second node N2 and connects the first node N1 and the third node N3; and the driving sub-circuit 20 adjusts a voltage level at the first node N1 according to the first power source signal outputted from the first power source signal terminal VDD and the data signal.

Step 103, a light emitting stage, in which the light emitting control signal outputted from the light emitting control signal terminal EM is at a first voltage level, and the light emitting control sub-circuit 30 adjusts a voltage level at the second node N2 according to a voltage level of the reference signal outputted from the reference signal terminal Vref; and the driving sub-circuit 20 adjusts a voltage level at the first node N1 according to a voltage level at the second node N2, and outputs a driving current to the third node N3 under control of the first node N1; the light emitting control sub-circuit 30 outputs the driving current to the light emitting sub-circuit 40, and the light emitting sub-circuit 40 emits light.

Step 104, a first maintaining stage, in which a voltage level of the light emitting control signal outputted from the light emitting control signal terminal EM jumps from a first voltage level to a second voltage level, and the voltage stabilizing sub-circuit 50 maintains a voltage level at the second node N2 unchanged under control of the voltage stabilizing signal outputted from the voltage stabilizing signal terminal.

Step 105, a second maintaining stage, in which a voltage level of the light emitting control signal outputted from the light emitting control signal terminal EM jumps from a second voltage level to a first voltage level, the light emitting control sub-circuit 30 adjusts a voltage level at the second node N2 according to a voltage level of the reference signal outputted from the reference signal terminal Vref; the driving sub-circuit 20 adjusts a voltage level at the first node N1 according to a voltage level at the second node N2, and outputs a driving current to the third node N3 under control of the first node N1; the light emitting control sub-circuit 30 outputs the driving current to the light emitting sub-circuit 40, and the light emitting sub-circuit 40 emits light.

The driving method may further comprise step 101, a resetting stage, which is prior to the data voltage writing stage and in which the reset signal outputted from the reset signal terminal RST is at a first voltage level and the reset sub-circuit 60 outputs an initializing signal from the initializing signal terminal Vin to the first node N1, and the initializing signal is at a first voltage level.

To sum up, an embodiment of the present disclosure provides a driving method of a pixel circuit. The driving method may further comprise a maintaining stage. In the maintaining stage, a voltage level of the light emitting control signal jumps from a first voltage level to a second voltage level, and the voltage stabilizing sub-circuit in the pixel circuit can avoid the influence caused by a voltage level change of the light emitting control signal on a voltage level of the second node, so that a voltage level at the second node maintains unchanged during the maintaining stage, thereby preventing the uneven luminance phenomenon from happening to the display device.

It should be noted that a voltage level of the light emitting control signal jumps between a first voltage level and a second voltage level many times after the light emitting stage, so that the pixel circuit alternately executes the first maintaining stage and the second maintaining stage. However, since a voltage level of the stabilizing voltage signal is always kept unchanged, the voltage stabilizing sub-circuit can maintain a voltage level at the second node always unchanged during alternations between the first maintaining stage and the second maintaining stage under control of the voltage stabilizing signal.

Figure 6:
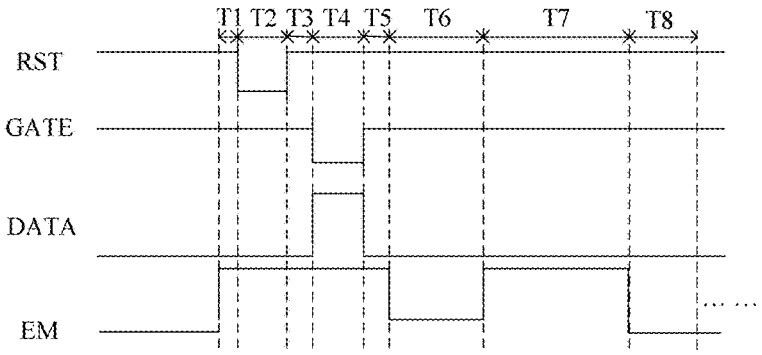
FIG. 6 is a timing diagram of a driving process of a pixel circuit according to an embodiment of the present disclosure.

Furthermore, taking the pixel circuit shown in FIG. 2 as an example, the driving method according to an embodiment of the present disclosure will be described in detail. FIG. 6 is a timing diagram of a driving process of a pixel circuit according to an embodiment of the present disclosure.

Referring to FIG. 6, the driving process comprises eight stages, which successively are: a preparing stage T1, a resetting stage T2, a first transition stage T3, a data voltage writing stage T4, a second transition stage T5, a light emitting stage T6, a first maintaining stage T7 and a second maintaining stage T8. It should be understood that T2 is not necessary for the technical solution of the present disclosure, and a length of each stage shown in FIG. 6 is merely exemplary, rather than intended to limit the present disclosure. The technical solution of the present disclosure is to solve the problem that change of the light emitting control signal may make the voltage at some nodes in the pixel circuit unstable. In the first maintaining stage, a voltage level of the light emitting control signal jumps from a first voltage level to a second voltage level, the voltage stabilizing sub-circuit in the pixel circuit can avoid the influence caused by a voltage level change of the light emitting control signal on a voltage level of the second node, so that a voltage level at the second node maintains unchanged during the maintaining stage, thereby preventing the uneven luminance phenomenon of the display device.

Prior to the resetting stage T2, the driving method further comprises a preparing stage T1. In the preparing stage T1, the reset signal outputted from the reset signal terminal RST and the scan signal outputted from the scan signal terminal GATE are both at a second voltage level, the light emitting control signal outputted from the light emitting control signal terminal EM jumps from a first voltage level to a second voltage level. In this case, the first transistor M1, the second transistor M2 and the fourth transistor M4 are turned off, the fifth transistor M5 and the sixth transistor M6 are both switched from a turned-on state into a turned-off state, and the first capacitor C1 can maintain a voltage level at the second node N2 unchanged under control of the voltage stabilizing signal (e.g., the first power source signal outputted from the first power source signal terminal VDD), preparing for signal writing.

In the resetting stage T2, the reset signal outputted from the reset signal terminal RST jumps from a second voltage level to a first voltage level, the first transistor M1 is turned on, and the initializing signal terminal Vin outputs the initializing signal to the first node N1 so as to initialize a voltage level at the first node N1. At this moment, a voltage level at the second node N2 is a certain stable voltage level Vx, and a magnitude of the voltage level Vx is related to a voltage level Vdata0 of the data signal in the previous stage. Specifically, Vx=Vref−(Vdd+Vth+Vref−Vdata0−Vin)×C1/(C1+C2), where Vth is a threshold voltage of the third transistor M3, Vdd is a voltage level of the first power source signal, Vref is a voltage level of the reference signal, Vin is a voltage level of the initializing signal, and C1 and C2 are capacitance values of the first capacitor and the second capacitor, respectively. Since a voltage level of the scan signal is maintained at a second voltage level at this moment, the second transistor M2 and the fourth transistor M4 continue to maintain in a turned-off state, and a voltage level of the light emitting control signal is also maintained at a second voltage level, thus the fifth transistor M5 and the sixth transistor M6 maintain in a turned-off state.

Referring to FIG. 6, after the resetting stage T2 and prior to the data voltage writing stage T4, the driving method further comprises a first transition stage T3. In the first transition stage T3, the reset signal jumps from a first voltage level to a second voltage level, and signals outputted from the scan signal terminal GATE and the light emitting control signal terminal EM are both at a second voltage level, and the first transistor M1 to the sixth transistor M6 are all turned off, preparing for data signal writing.

In the data voltage writing stage T4, the scan signal jumps from a second voltage level to a first voltage level, the second transistor M2 and the fourth transistor M4 are turned on, and the data signal terminal DMA outputs the data signal to the second node N2, and at this moment, a voltage level at the second node N2 is a voltage level Vdata of the data signal. Due to turn-on of the second transistor M2, the gate and the drain of the third transistor M3 are connected, and at this moment, the third transistor M3 is in a diode turn-on state. Since a voltage level at the gate (i.e. the first node N1) of the third transistor M3 is the voltage level Vin of the initializing signal, a voltage level at the source of the third transistor M3 is the voltage level Vdd of the first power source signal (the voltage level Vdd of the first power source signal is a high voltage level with respect to the voltage level Vin of the initializing signal), thus the first power source signal terminal VDD can charge the first node N1. Moreover, since the threshold voltage of the third transistor M3 is Vth, the third transistor M3 is turned off when the first power source signal terminal VDD pulls up the voltage level at the first node N1 to Vdd+Vth.

In the second transition stage T5, the reset signal maintains a second voltage level, the scan signal jumps from a first voltage level to a second voltage level, and the second capacitor C2 maintains voltage levels at the first node N1 and the second node N2 unchanged. That is, a voltage level at the first node N1 is maintained as Vdd+Vth and a voltage level at the second node N2 is maintained as Vdata.

The first transition stage T3 and the second transition stage T5 described above may allow a certain interval between the reset signal and the scan signal and between the scan signal and the light emitting control signal. Since two signals are enabled simultaneously (i.e., being at the first voltage level simultaneously), unnecessary current loops are formed in the pixel circuit, affecting the driving effect of the pixel circuit. Therefore, the two transition stages effectively prevent two signals from being enabled simultaneously, thereby ensuring a normal operation of the pixel circuit.

In the light emitting stage 16, the light emitting control signal jumps from a second voltage level to a first voltage level, the fifth transistor M5 and the sixth transistor M6 are turned on, and the reference signal terminal Vref outputs the reference signal to the second node N2, and at this moment, a voltage level at the second node N2 becomes Vref and the change in the voltage level at the second node N2 is Vref−Vdata. Correspondingly, the second capacitor C2 can adjust a voltage level at the first node N1 according to a voltage level at the second node N2, and at this time, a voltage level at the first node N1 becomes Vdd+Vth+(Vref−Vdata). In this case, the third transistor M3 is turned on, a gate-source voltage Vgs of the third transistor M3 is a difference between a gate voltage level (i.e., a voltage level at the first node N1) and a source voltage level (i.e., a voltage level Vdd of the first power source signal), that is, Vgs=Vref+Vth−Vdata. At this time, the third transistor M3 may output a driving current to the OLED so as to drive the OLED to emit light. An amplitude of the driving current Id outputted through the third transistor M3 can be expressed as:

$$Id = K \times (Vgs - Vth)^2 = K \times (Vref - Vdata)^2; \quad \text{Formula (1)}$$

$$\text{where } K = \frac{1}{2} \times \frac{W}{L} \cdot C \cdot \mu;$$

Specifically, μ is a carrier mobility of the third transistor M3, C is a capacitance of a gate insulating layer of the third transistor M3, and W/L is a width-to-length ratio of the third transistor M3. It can be seen from the Formula (1) that the amplitude of the driving current Id is independent of the threshold voltage Vth of the third transistor M3, thereby the influence caused by the threshold voltage shift of the driving transistor on the light emitting effect is avoided, display luminance uniformity of the OLED display panel is improved, and display effect of the OLED display panel is enhanced.

Further, in the first maintaining stage T7, the light emitting control signal jumps from a first voltage level to a second voltage level. The first capacitor C1 can maintain a voltage level at the second node N2 unchanged under control of the stabilizing signal (e.g., the first power source signal).

In practice, display luminance of the display device can be adjusted by adopting a method of Pulse Width Modulation (PWM). That is, display luminance of the display device is changed by adjusting the number of times of voltage level jumps of the light emitting control signal within one frame and duration of each voltage level. Adjustment on the pulse width of the light emitting control signal will affect the number of times of alternation appearance of the light emitting stage T6 and the first maintaining stage T7 in FIG. 6 and duration of each stage. In the related art, after the pixel circuit switches from the light emitting stage T6 into the first maintain stage T7, both the fourth transistor M4 and the fifth transistor M5 are in a turned-off state. In this case, voltage levels at the second node N2 and the first node N1 are not controlled by any other signal terminals, that is, they are both in a floating state. A voltage level at the floating node is easily subjected to coupling interference of an external signal as well as influence of a leakage current of the transistor in the pixel circuit, thereby affecting the data voltage written into the pixel circuit, which may easily result in uneven luminance of the display device and affect the display effect.

In the pixel circuit according to an embodiment of the present disclosure, the voltage stabilizing sub-circuit 50 can maintain a voltage level at the second node N2 unchanged through the voltage stabilizing signal from the stabilizing signal terminal after a voltage level of the light emitting control signal jumps to the second voltage level. Further, the second capacitor C2 in the driving sub-circuit 20 can maintain a voltage level at the first node N1 unchanged under the effect of the second node N2. Therefore, the pixel circuit according to an embodiment of the present disclosure can effectively prevent voltage drift at the two nodes and achieve stable display of the display device.

Figure 7:
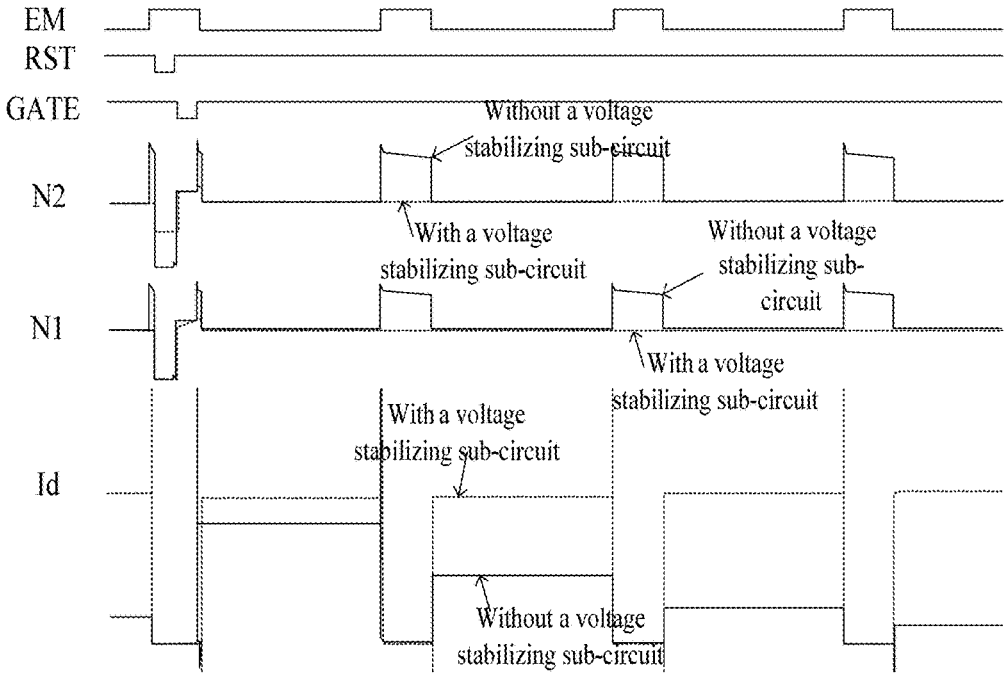
FIG. 7 is a schematic diagram of voltage levels at respective signal terminals, voltage levels at respective nodes, and a magnitude of the driving current in a driving process of a pixel circuit according to an embodiment of the present disclosure.

FIG. 7 is a schematic diagram of voltage levels at respective signal terminals, voltage levels at respective nodes, and a magnitude of the driving current in a driving process of a pixel circuit according to an embodiment of the present disclosure. It should be understood that, lengths of the respective segments of signals shown in FIG. 7 are merely schematic, rather than intended to limit the present disclosure. In the timing of the first node N1, the second node N2 and the driving current Id in FIG. 7, the solid line is the timing in the case that no the voltage stabilizing sub-circuit is provided in the related art, and the dotted line is the timing in the case that the voltage stabilizing sub-circuit is provided in the embodiment of the present disclosure. It can be seen from FIG. 7 that, in the pixel circuit without the voltage stabilizing sub-circuit in the related art, voltage levels at the first node N1 and the second node N2 and the magnitude of the driving current Id are greatly affected by the light emitting control signal. After a voltage level of the light emitting control signal outputted from the light emitting control signal terminal EM jumps to the second voltage level, the driving current Id and voltage levels at the two nodes also fluctuate, and as the number of times of voltage level jumps of the light emitting control signal increases, the driving current Id also decreases continually. In the pixel circuit according to an embodiment of the present disclosure, voltage levels at the first node N1 and the second node N2 and the amplitude of the driving current Id are less affected by the light emitting control signal. After a voltage level of the light emitting control signal jumps to the second voltage level, voltage levels at the two nodes are relatively stable, and fluctuation of the driving current Id is relatively small, that is, stability of the driving current Id is high, thereby ensuring that display luminance uniformity of the display device is not affected when the luminance of the display device is adjusted by the PWM method.

To sum up, an embodiment of the present disclosure provides a driving method for a pixel circuit, and the driving method further comprises a maintaining stage. In this maintaining stage, a voltage level of the light emitting control signal jumps from a first voltage level to a second voltage level, and the voltage stabilizing sub-circuit in the pixel circuit can avoid the influence caused by voltage level change of the light emitting control signal on a voltage level at the second node, so that the voltage level at the second node maintains unchanged during the maintaining stage, thereby avoiding the uneven luminance phenomenon from happening to the display device.

It should be noted that, in the above embodiments, description is provided with all of the first to sixth transistors being P-type transistors, and the first voltage level being a low voltage level relative to the second voltage level as an example. Of course, the first to sixth transistors may also N-type transistors, and when the first to sixth transistors are N-type transistors, the first voltage level may be a high voltage level with respect to the second voltage level, and voltage level change at the respective signal terminals may be opposite to a voltage level change shown in FIGS. 6 and 7 (i.e., a phase difference between the two cases is 180 degrees).

An embodiment of the present disclosure further provides a display device, and the display device may comprise a pixel circuit as shown in any one of FIGS. 1 to 4. The display device may be any product or component having a display function, such as an electronic paper, an OLED panel, an AMOLED panel, a cell phone, a tablet computer, a television, a display, a notebook computer, a digital photo frame and a navigator.

Those skilled in the art may clearly understand that, for convenience and simplicity, as for specific operation process of the pixel circuit and the respective sub-circuits described above, reference may be made to corresponding process in the foregoing driving method embodiments, and details are not described herein again.

The above is only the preferred embodiments of the present disclosure and is not intended to limit the present disclosure. Any modifications, equivalent alternatives, improvements etc. within the spirit and principle of the present disclosure should be included within the protection scope of the present disclosure.

The present application claims priority of the Chinese Patent Application No. 201710086986.2 and entitled "PIXEL CIRCUIT AND DRIVING METHOD THEREOF, AND DISPLAY DEVICE" filed on Feb. 17, 2017, the entire disclosure of which is hereby incorporated herein by reference as part of the present application.

What is claimed is:

1. A pixel circuit, comprising: an input sub-circuit, a driving sub-circuit, a light emitting control sub-circuit, a light emitting sub-circuit and a voltage stabilizing sub-circuit;

the input sub-circuit is connected respectively to a scan signal terminal, a data signal terminal, a first node, a second node and a third node, and configured to output a data signal from the data signal terminal to the second node, and connect the third node with the first node under control of a scan signal from the scan signal terminal;

the driving sub-circuit is connected respectively to a first power source signal terminal, the first node, the second node and the third node, and configured to adjust a voltage level at the first node according to a voltage level at the second node and a first power source signal outputted from the first power source signal terminal when the input sub-circuit connects the third node with the first node, and output a driving current to the third node according to a first power source signal outputted from the first power source signal terminal under control of the first node when the input sub-circuit does not connect the third node with the first node;

the light emitting control sub-circuit is connected respectively to a light emitting control signal terminal, a reference signal terminal, the second node, the third node and one terminal of the light emitting sub-circuit, and configured to control a voltage level at the second node according to a reference signal from the reference signal terminal under control of a light emitting control signal from the light emitting control signal terminal, and output the driving current to a first terminal of the light emitting sub-circuit under control of the light emitting control signal from the light emitting control signal terminal;

a second terminal of the light emitting sub-circuit is connected to a second power source signal terminal, the light emitting sub-circuit is configured to emit light under driving of the driving current;

the voltage stabilizing sub-circuit is connected respectively to the second node and a voltage stabilizing signal terminal, and configured to stabilize a voltage level at the second node under control of a voltage stabilizing signal from the voltage stabilizing signal terminal, and the voltage level of the voltage stabilizing signal is always unchanged during driving process of the pixel circuit.

2. The pixel circuit according to claim 1, further comprising a reset sub-circuit connected respectively to a reset signal terminal, an initializing signal terminal and the first node, and configured to output an initializing signal from the initializing signal terminal to the first node under control of a reset signal from the reset signal terminal.

3. The pixel circuit according to claim 2, wherein the reset sub-circuit comprises:

a first transistor;

a gate of the first transistor is connected to the reset signal terminal, a first electrode of the first transistor is connected to the initializing signal terminal, and a second electrode of the first transistor is connected to the first node.

4. The pixel circuit according to claim 2, wherein the voltage stabilizing signal terminal is any one of the first power source signal terminal, the second power source signal terminal, the reference signal terminal and the initializing signal terminal.

5. The pixel circuit according to claim 1, wherein the voltage stabilizing sub-circuit comprises:

a first capacitor;

a first terminal of the first capacitor is connected to the second node, and a second terminal of the first capacitor is connected to the voltage stabilizing signal terminal.

6. The pixel circuit according to claim 1, wherein the input sub-circuit comprises:

a second transistor and a fourth transistor;

a gate of the second transistor is connected to the scan signal terminal, a first electrode of the second transistor is connected to the third node, and a second electrode of the second transistor is connected to the first node;

a gate of the fourth transistor is connected to the scan signal terminal, a first electrode of the fourth transistor is connected to the data signal terminal, and a second electrode of the fourth transistor is connected to the second node.

7. The pixel circuit according to claim 6, the transistors are both P-type transistors.

8. The pixel circuit according to claim 1, wherein the driving sub-circuit comprises:

a third transistor and a second capacitor;

a gate of the third transistor is connected to the first node, a first electrode of the third transistor is connected to the first power source signal terminal, and a second electrode of the third transistor is connected to the third node;

a first terminal of the second capacitor is connected to the first node, and a second terminal of the second capacitor is connected to the second node.

9. The pixel circuit according to claim 1, wherein the light emitting control sub-circuit comprises: a fifth transistor and a sixth transistor;

a gate of the fifth transistor is connected to the light emitting control signal terminal, a first electrode of the fifth transistor is connected to the reference signal terminal, and a second electrode of the fifth transistor is connected to the second node;

a gate of the sixth transistor is connected to the light emitting control signal terminal, a first electrode of the sixth transistor is connected to the third node, and a second electrode of the sixth transistor is connected to one terminal of the light emitting sub-circuit.

10. The pixel circuit according to claim 1, wherein the light emitting sub-circuit comprises: an organic light emitting diode OLED;

a first terminal of the OLED is connected to the light emitting control sub-circuit, and a second terminal of the OLED is connected to the second power source signal terminal.

11. A display device, comprising: the pixel circuit according to claim 1.

12. A driving method for driving the pixel circuit according to claim 1, the driving method comprising:

a data voltage writing stage, in which the scan signal outputted from the scan signal terminal is at a first voltage level, the input sub-circuit outputs the data signal from the data signal terminal to the second node and connects the first node and the third node, and the driving sub-circuit adjusts a voltage level at the first node according to the first power source signal outputted from the first power source signal terminal and the data signal;

a light emitting stage, in which the light emitting control signal outputted from the light emitting control signal terminal is at a first voltage level, and the light emitting control sub-circuit adjusts a voltage level at the second node according to a voltage level of the reference signal outputted from the reference signal terminal; and the driving sub-circuit adjusts a voltage level at the first node according to a voltage level at the second node, and outputs a driving current to the third node under control of the first node; the light emitting control sub-circuit outputs the driving current to the light emitting sub-circuit, and the light emitting sub-circuit emits light;

a first maintaining stage, in which a voltage level of the light emitting control signal outputted from the light emitting control signal terminal jumps from a first voltage level to a second voltage level, and the voltage stabilizing sub-circuit maintains a voltage level at the second node unchanged under control of the voltage stabilizing signal outputted from the voltage stabilizing signal terminal; and a second maintaining stage, in which a voltage level of the light emitting control signal outputted from the light emitting control signal terminal jumps from a second voltage level to a first voltage level, the light emitting control sub-circuit adjusts a voltage level at the second node according to a voltage level of the reference signal outputted from the reference signal terminal; the driving sub-circuit adjusts a voltage level at the first node according to a voltage level at the second node, and outputs the driving current to the third node under control of the first node; the light emitting control sub-circuit outputs the driving current to the light emitting sub-circuit, and the light emitting sub-circuit emits light.

13. The driving method according to claim 12, wherein the first maintaining stage and the second maintaining stage are alternated when a voltage level of the light emitting control signal jumps between a first voltage level and a second voltage level.

14. The driving method according to claim 12, wherein the voltage stabilizing sub-circuit comprises a first capacitor; the input sub-circuit comprises a second transistor and a fourth transistor; and the driving sub-circuit comprises a third transistor and a second capacitor; the light emitting control sub-circuit comprises a fifth transistor and a sixth transistor; the light emitting sub-circuit comprises an organic electroluminescent diode OLED;

in the data voltage writing stage, the scan signal is at a first voltage level, the second transistor and the fourth transistor are turned on, and the data signal terminal outputs the data signal to the second node, the third transistor is turned on, and a voltage level at the first node is adjusted according to a voltage level of the first power source signal;

in the light emitting stage, the light emitting control signal is at a first voltage level, the fifth transistor and the sixth transistor are turned on, the reference signal terminal outputs the reference signal to the second node, and the second capacitor adjusts a voltage level at the first node according to a voltage level at the second node, the third transistor is turned on and outputs the driving current to the OLED, and the OLED emits light;

in the first maintaining stage, the light emitting control signal is at a second voltage level, and the first capacitor maintains a voltage level at the second node unchanged under control of the voltage stabilizing signal;

in the second maintaining stage, the light emitting control signal is at a first voltage level, the fifth transistor and the sixth transistor are turned on, and the reference signal terminal outputs the reference signal to the second node, the second capacitor adjusts a voltage level at the first node according to a voltage level at the second node, the third transistor is turned on and outputs the driving current to the OLED, and the OLED emits light.

15. The driving method according claim 14, wherein all of the transistors are P-type transistors, and the first voltage level is a low voltage level with respect to the second voltage level.

16. The driving method according to claim 12, wherein the pixel circuit further comprises a reset sub-circuit connected respectively to a reset signal terminal, an initializing signal terminal and the first node, and configured to output an initializing signal from the initializing signal terminal to the first node under control of a reset signal from the reset signal terminal, the driving method further comprises: a resetting stage, which is prior to the data voltage writing stage and in which the reset signal outputted from the reset signal terminal is at a first voltage level and the reset sub-circuit outputs the initializing signal from the initializing signal terminal to the first node, and the initializing signal is at a first voltage level.

17. The driving method according to claim 16, wherein the reset sub-circuit comprises: a first transistor;

in the resetting stage, the reset signal is at a first voltage level, the first transistor is turned on, and the initializing signal terminal outputs the initializing signal to the first node.

18. The driving method according to claim 17, wherein the driving method further comprises: a preparing stage which is prior to the resetting stage;

in the preparing stage, the reset signal and the scan signal are both at a second voltage level, the light emitting control signal jumps from a first voltage level to a second voltage level, the first transistor, the second transistor, and the fourth to sixth transistors are all turned off, and the first capacitor maintains a voltage level at the second node unchanged under control of the voltage stabilizing signal.

19. The driving method according to claim 18, wherein the driving method further comprises a first transition stage which is after the resetting stage and prior to the data voltage writing stage; the driving method further comprises a second transition stage which is after the data voltage writing stage and prior to the light emitting stage;

in the first transition stage, the reset signal jumps from a first voltage level to a second voltage level, and signals outputted from the scan signal terminal and the light emitting control signal terminal both are at a second voltage level, and the first to sixth transistors are all turned off;

in the second transition stage, the reset signal maintains at a second voltage level, the scan signal jumps from a first voltage level to a second voltage level, the second capacitor maintains voltage levels at the first node and the second node unchanged.

* * * * *